US005492637A

United States Patent [19]

Lehti

[11] Patent Number: 5,492,637

[45] Date of Patent: Feb. 20, 1996

[54] METHOD FOR IMPROVING THE EFFICIENCY OF AN ENGINE

[76] Inventor: Edward J. Lehti, 1221 11th St., West Babylon, N.Y. 11704

[21] Appl. No.: 447,032

[22] Filed: May 22, 1995

Related U.S. Application Data

[63] Continuation of Ser. No. 167,327, Dec. 14, 1993, abandoned, which is a continuation of Ser. No. 874,062, Apr. 24, 1992, abandoned.

[51] Int. Cl.[6] ..... C10M 127/00

[52] U.S. Cl. ..... 252/9; 585/13

[58] Field of Search ..... 252/9, 11; 208/15, 208/17, 18, 19; 585/13, 6.6, 7

[56] References Cited

U.S. PATENT DOCUMENTS

| | | | |
|---|---|---|---|
| 4,174,231 | 11/1979 | Hobgood | 134/10 |
| 4,329,240 | 5/1982 | Lilburn | 252/51.5 A |
| 4,992,187 | 2/1991 | Adams et al. | 252/50 |

*Primary Examiner*—Prince Willis, Jr.
*Assistant Examiner*—Alan D. Diamond
*Attorney, Agent, or Firm*—Darby & Darby

[57] ABSTRACT

A method for lubricating engine parts, in which kerosene is added to engine lubricating oil. Upon running the engine, the kerosene is circulated through the engine, acting as a solvent to remove any deposits within the engine and cause the deposits to be expelled through the exhaust system.

2 Claims, No Drawings

METHOD FOR IMPROVING THE EFFICIENCY OF AN ENGINE

This is a continuation of application Ser. No. 08/167,327, filed Dec. 14, 1993 now abandoned, which is a continuation of application Ser. No. 07/874,062 filed on Apr. 24, 1992 which is now abandoned.

FIELD OF THE INVENTION

This invention relates generally to compositions for facilitating operation of mechanisms. More specifically, the invention relates to a composition that is used for lubricating engine parts.

BACKGROUND OF THE INVENTION

It has long been established that without lubrication, many engines generate enough heat through friction to fuse the moving parts. Unfortunately, in many cases, the same compositions used for lubrication to reduce the friction can lose some of their viscosity over time, decreasing the efficiency of the engine.

To complement the common petroleum derivatives currently used, a host of commercially-available products have been introduced, with varying degrees of success. There have been such a large number of these additives that the United States Environmental Protection Agency will only evaluate fully developed products and then, only on a voluntary basis. Unfortunately, many of these products have little beneficial or sometimes detrimental effects.

It is thus an object of the invention to provide an engine oil lubricant composition that improves the efficiency of the engine.

It is a further object to provide a lubricant composition that provides cleaning of the engine passages while it lubricates.

It is another object to provide a lubricant composition that will not leave any deposits or residues within the engine.

It is yet another object to provide a lubricant composition that is economical and simple to use.

SUMMARY OF THE INVENTION

In accordance with the objects of the invention, kerosene is added to engine lubricating oil. Upon running the engine, the kerosene is circulated through the engine, acting as a solvent to remove any deposits within the engine and cause the deposits to be expelled through the exhaust system.

DETAILED DESCRIPTION OF THE PREFERRED EMBODIMENTS

Kerosene is a liquid hydrocarbon fuel commonly obtained from the fractional distillation of petroleum. Kerosene is available in various grades, but the preferred grade of kerosene used in the invention is available as fuel for portable heaters, such as K1 grade kerosene.

The kerosene is preferably mixed with common motor oil in the oil reservoir of an engine. The motor oil is preferably 10W40 grade, although any common type will work similarly. Preferably, the kerosene can be added to the oil after it is within the reservoir of the engine. Alternatively, the kerosene can be mixed with the motor oil before being added to the engine, such as during a routine oil change. Preferably, the resulting kerosene/oil composition will be have approximately 1 (one) part kerosene to about 4–5 parts motor oil, although other concentrations may work similarly, as discussed below.

The complete action of the kerosene/oil mixture is not fully known, although significant benefits in car efficiency and emission control have been demonstrated, as described more fully below by example. Without wishing to be bound by theory, it is believed that certain actions may be occurring with respect to the composition, as follows.

One known action of the kerosene/oil mixture is the cleansing of the internal passages of the engine through the solvent action of the kerosene. Oil and carbon deposits that tend to form on the interior surfaces of the various conduits within the engine are assumed to dissolve in the kerosene, and then circulate through the oil system and either become trapped by the oil filter or expelled through the exhaust system.

Since the boiling point of kerosene is between 150°–300° C., it is expected that some of the kerosene becomes vaporized and eventually burns within the cylinders along with the gasoline. The boiling point of motor oil is generally significantly higher than 300° C. The burning of the kerosene may alter the combustion temperature within the cylinders, affecting the level of oxidation of the gasoline, which would thus affect the level of hydrocarbon emissions from the exhaust. Since it is believed that the kerosene will eventually be completely burned away from the kerosene/oil mixture, it is preferred that the oil component of the composition be present in sufficient quantities to maintain proper functioning of the engine after the kerosene is completely oxidized.

If the kerosene does not become vaporized and oxidized, it is expected that it would continue to circulate as part of the oil/kerosene composition, providing a continuous cleaning effect on the internal parts of the engine.

Compositions used in automobiles to date have ranged from 6 parts kerosene/1 part motor oil to 1 part kerosene/12 parts motor oil.

EXAMPLE 1

An automobile with approximately 110,000 odometer miles was determined to have a hydrocarbon emission content of 322 parts per million (ppm), considerably higher than the current allowable limit set by the New York State Department of Motor Vehicles. The oil in the engine was replaced with a composition comprised of 1 pint of kerosene and approximately 5 quarts of motor oil, in addition to replacing the spark plugs. After running the automobile for an additional 400 miles, the emission content had been reduced to 97 ppm, well under the 220 ppm limit.

EXAMPLE 2

Another automobile with approximately 125,000 miles on the odometer experienced a 20% increase in the miles per gallon efficiency of the engine after the oil was replaced with a lubricating composition according to the invention.

While the embodiments described are fully capable of achieving the objects and advantages of the invention, these embodiments are described for the purpose of illustration and not for limitation.

What is claimed is:

1. A method of improving the efficiency of an automobile having an engine which has a lubricant in the oil reservoir of the engine, comprising the steps of:

providing an oil composition consisting essentially of 8%–20% by volume of kerosene and 80%–92% by volume of motor oil;

determining the content of exhaust emissions of said engine and comparing said content to a hydrocarbon emissions content standard;

draining the lubricant from the oil reservoir if said content exceeds said automobile emissions standard and adding said oil composition as the lubricant to the oil reservoir;

circulating said oil composition through said engine by operating said engine; and retaining said oil composition as the lubricant within the oil reservoir when operating said engine during the normal operation of the automobile.

2. The method of claim 1, wherein said hydrocarbon emissions content standard is less than or equal to 220 ppm.

* * * * *